US007815181B2

(12) United States Patent
Okuno

(10) Patent No.: US 7,815,181 B2
(45) Date of Patent: Oct. 19, 2010

(54) RECORDING APPARATUS

(75) Inventor: Tokujiro Okuno, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 57 days.

(21) Appl. No.: 12/392,281

(22) Filed: Feb. 25, 2009

(65) Prior Publication Data

US 2009/0212495 A1 Aug. 27, 2009

(30) Foreign Application Priority Data

Feb. 26, 2008 (JP) ..... 2008-045137
Oct. 31, 2008 (JP) ..... 2008-282545

(51) Int. Cl.
*B65H 5/22* (2006.01)
*B65H 83/00* (2006.01)
*B65H 85/00* (2006.01)

(52) U.S. Cl. ..... 271/3.14; 271/272; 271/314

(58) Field of Classification Search ..... 271/3.14, 271/272, 314; 347/104
See application file for complete search history.

(56) References Cited

U.S. PATENT DOCUMENTS 5,163,674 A * 11/1992 Parks ..... 271/274
6,761,425 B2 * 7/2004 Kawaguchi et al. ..... 347/16
6,789,889 B2 * 9/2004 Rasmussen et al. ..... 347/104
6,986,574 B2 * 1/2006 Nojima et al. ..... 347/104
7,527,371 B2 * 5/2009 Yanagi et al. ..... 347/104
7,568,696 B2 * 8/2009 Henson ..... 271/270
2002/0171198 A1 * 11/2002 DeFosse et al. ..... 271/272
2005/0001892 A1 * 1/2005 Yoshihisa et al. ..... 347/104
2008/0164652 A1 * 7/2008 Otsuki ..... 271/272

FOREIGN PATENT DOCUMENTS

JP 09-048161 2/1997
JP 10-291569 11/1998
JP 2001-114450 4/2001
JP 2001-240286 9/2001

* cited by examiner

*Primary Examiner*—David H Bollinger
(74) *Attorney, Agent, or Firm*—Workman Nydegger

(57) ABSTRACT

A recording apparatus includes a recording head, a transport driving roller, and a transport driven roller. The recording head discharges ink onto a transported recording medium, thereby performing recording. The transport driving roller is provided on the upstream side of the recording head in the transport direction and includes driving side roller portions and depressed portions. The driving side roller portions are rotationally driven, thereby transporting the recording medium. The diameter of the depressed portions is smaller than that of the driving side roller portions. The driving side roller portions and the depressed portions are arranged in a direction perpendicular to the transport direction of the recording medium in such a manner that at least one driving side roller portion alternates with at least one depressed portion. The transport driven roller is provided opposite the transport driving roller and includes driven side roller portions and presser rollers.

6 Claims, 8 Drawing Sheets

RECORDING APPARATUS

BACKGROUND

1. Technical Field

The present invention relates to a recording apparatus. More specifically, the invention relates to a recording apparatus that discharges ink onto a transported recording medium, thereby performing recording.

2. Related Art

There is known an ink jet recording apparatus that corrugates and transports a recording medium in a recording region of a recording head (see, for example, JP-A-9-48161). In this recording apparatus, a recording medium is corrugated by a transport guide disposed on the downstream side of a transport roller in the transport direction.

In the above recording apparatus, a recording medium passing through the transport roller is rapidly corrugated by the transport guide, and so the behavior of the recording medium is disturbed. In particular, the longer the distance between the transport roller and a discharge roller is, the more significant this disturbance is. Therefore, the wider the recording region of the recording head is in the transport direction, the more difficult it is to stabilizing the behavior of the recording medium. Due to the disturbance of behavior of the recording medium, the recording medium and the recording head can interfere, and the accuracy of ink hitting the recording medium can be insufficient.

SUMMARY

According to an aspect of the invention, a recording apparatus includes a recording head, a transport driving roller, and a transport driven roller. The recording head discharges ink onto a transported recording medium, thereby performing recording. The transport driving roller is provided on the upstream side of the recording head in the transport direction and includes driving side roller portions and depressed portions. The driving side roller portions are rotationally driven, thereby transporting the recording medium. The diameter of the depressed portions is smaller than that of the driving side roller portions. The driving side roller portions and the depressed portions are arranged in a direction perpendicular to the transport direction of the recording medium in such a manner that at least one driving side roller portion alternates with at least one depressed portion. The transport driven roller is provided opposite the transport driving roller and includes driven side roller portions and presser rollers. The driven side roller portions are driven by the driving side roller portions with the recording medium therebetween. The diameter of the presser rollers is larger than that of the driven side roller portions. The presser rollers press the recording medium toward the depressed portions. The driven side roller portions and the presser rollers are arranged in a direction perpendicular to the transport direction of the recording medium in such a manner that at least one driven side roller portion alternates with at least one presser roller. Thus, the recording medium can be corrugated with the transport driving roller and the transport driven roller and transported to the recording region of the recording head. As a result, a rapid change in the attitude of the recording medium passing between the transport driving roller and the transport driven roller can be suppressed, and so, in the recording region of the recording head, the recording medium can be transported further with the attitude stabilized.

It is preferable that the recording apparatus further include at least one bearing portion that rotatably supports at least one of the depressed portions, and the driving side roller portions be roughened, and the at least one of the depressed portion supported by the at least one bearing portion be smoother than the driving side roller portions. Thus, transporting force applied to the recording medium by the driving side roller portions and the driven side roller portions can be secured. In addition, the frictional resistance between the at least one bearing portion and the at least one of the depressed portions can be reduced, and the abrasion of the at least one bearing portion and the at least one of the depressed portions can be reduced.

It is preferable that the friction coefficient of the presser rollers be lower than the friction coefficient of the driven side roller portions. Thus, the transport impact of the presser rollers on the recording medium can be reduced.

It is preferable that a pair of the presser rollers be disposed at both edges of the recording medium in a direction perpendicular to the transport direction. Thus, the force that tries to flatten at each edge of the recording medium in a direction perpendicular to the transport direction can be suppressed, and so the behavior of the recording medium can be stabilized.

It is preferable that a presser rib be provided on the upstream side of each presser roller in the transport direction so as to extend along the transport direction toward the presser roller, the presser rib protruding from the presser roller side toward the depressed portion side, and that an upstream side guide rib be provided on the upstream side of each driving side roller portion in the transport direction so as to extend along the transport direction toward the driving side roller portion, the upstream side guide rib protruding from the driving side roller portion side toward the driven side roller portion side and supporting the recording medium. Thus, the recording medium can enter between the transport driving roller and the transport driven roller in a corrugated condition, and so the recording medium entering between the transport driving roller and the transport driven roller can be prevented from being folded and wrinkled.

It is preferable that the width of the presser rib in a direction perpendicular to the transport direction increase toward the downstream end in the transport direction. Thus, the recording medium transported to the transport driving roller and the transport driven roller can be corrugated more gently.

It is preferable that the recording apparatus further include a downstream side guide rib provided on the downstream side of each driving side roller portion in the transport direction so as to extend along the transport direction, the downstream side guide rib protruding from the driving side roller portion side toward the driven side roller portion side and supporting the recording medium. Thus, the variation in the clearance between the ridges of the recording medium and the recording head can be reduced.

It is preferable that both ends of each presser roller in the axial direction be curved as viewed from the radial direction. Thus, the recording medium can be curved along the presser rollers. As a result, the recording medium can be prevented from being folded and rubbed.

The above summary of the invention does not enumerate all necessary characteristics of the invention. The subcombinations of these characteristics may also embody the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Although the present invention will be described with reference to embodiments, the following embodiments do not limit the invention according to the scope of claims. Not all combinations of characteristics described in the embodiments are necessary for solving means of the invention.

Figure 1:
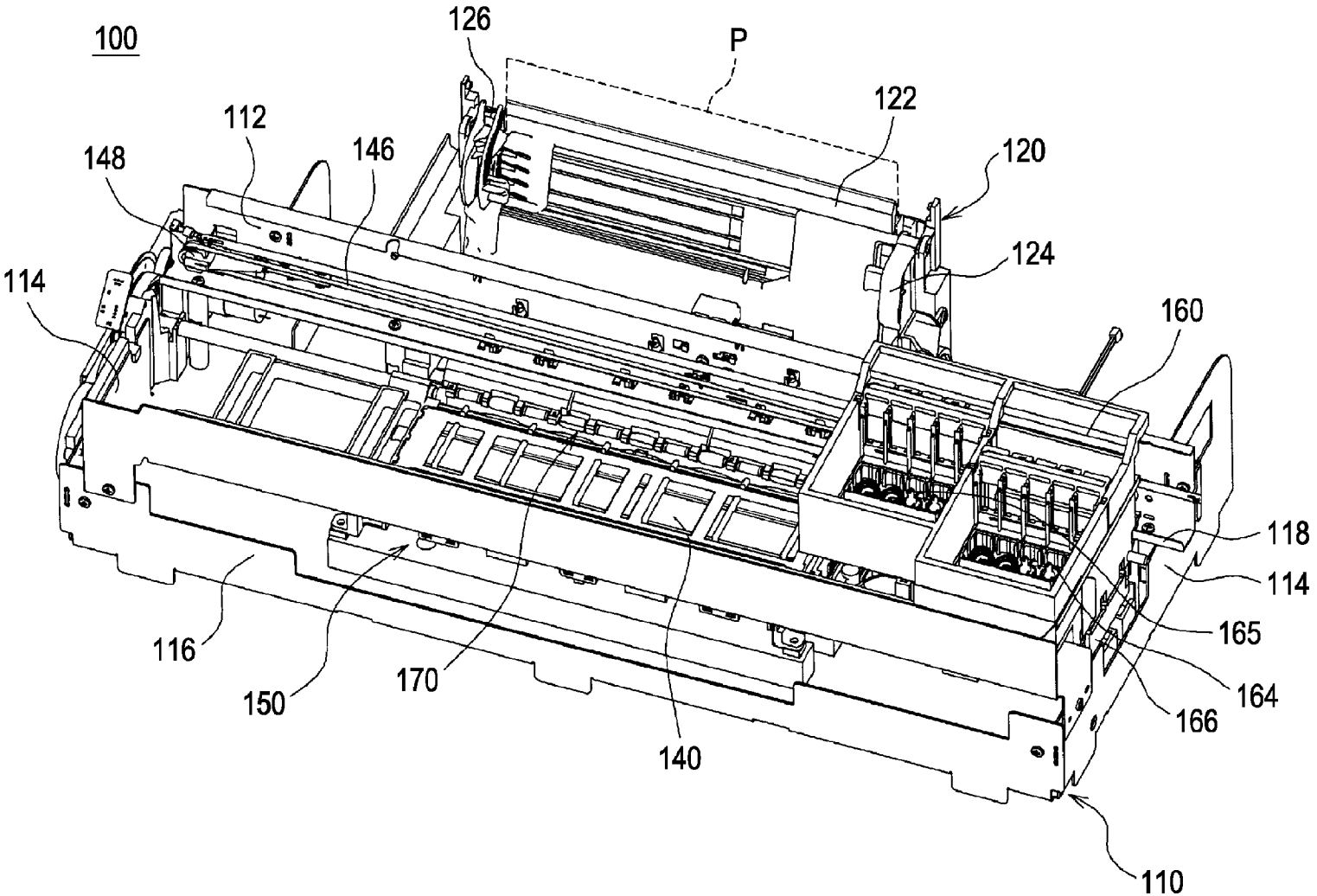
FIG. 1 is a perspective view showing the internal structure of an ink jet recording apparatus 100 according to an embodiment.
Figure 2:
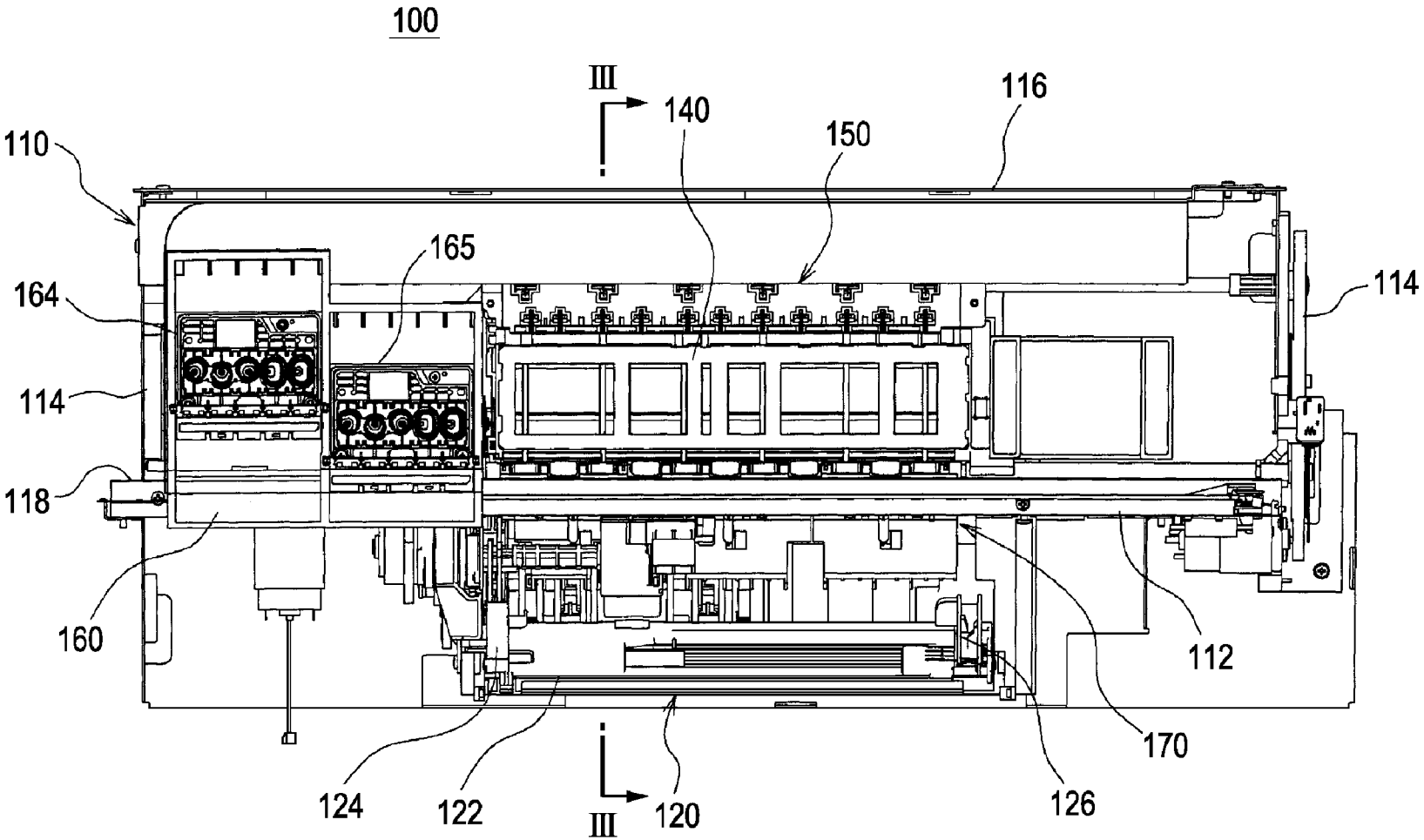
FIG. 2 is a plan view showing the internal structure of a recording apparatus 100 according to an embodiment.

FIG. 1 is a perspective view showing the internal structure of an ink jet recording apparatus 100 according to an embodiment. FIG. 2 is a plan view showing the internal structure of the recording apparatus 100.

The upstream side in the transport direction of paper P serving as a recording medium in the recording apparatus 100, the upper side in the figure, will be referred to as the rear side in the recording apparatus 100. The downstream side in the transport direction of paper P in the recording apparatus 100, the lower side in the figure, will be referred to as the front side in the recording apparatus 100. The direction perpendicular to the transport direction will be referred to as the paper width direction.

As shown in these figures, the recording apparatus 100 has a frame 110 that is rectangular in planar view, and an internal mechanism mounted on the frame 110 and including a transport section 170 and a carriage 160. Behind the frame 110 is disposed a paper feed tray 120. The paper feed tray 120 has a paper support 122 extending obliquely upward, and a side support 124 and slide support 126 disposed on both sides of the paper support 122 in the direction perpendicular to the transport direction (hereinafter referred to as the paper width direction).

The paper support 122 supports paper P from behind in the rear of the recording apparatus 100. The side support 124 is fixed to one edge (the right edge in the figure) of the paper support 122 in the paper width direction. The slide support 126 is attached to the paper support 122 slidably in the paper width direction, that is, toward and away from the side support 124. By sliding the slide support 126 toward the side support 124 so as to sandwich paper P between the slide support 126 and the side support 124 in the paper width direction, paper P of various widths can be positioned in the width direction.

The frame 110 includes a rear frame 112 stood in the rear of the apparatus, side frames 114 stood on both right and left sides of the apparatus, and a front frame 116 stood in the front of the apparatus. The rear frame 112 supports the carriage 160 in the front thereof. The carriage 160 can move horizontally along a guide portion 118 formed in the lower part of the rear frame 112. Between the carriage 160 and the rear frame 112 is disposed a timing belt 146 that is laid in a tensioned condition substantially horizontally between a pair of pulleys 148. Part of the timing belt 146 is attached to the carriage 160. The pulleys 148, being rotationally driven, rotate the timing belt 146, thereby reciprocating the carriage 160 in a substantially horizontal direction.

On the bottom surface of the carriage 160 are mounted recording heads 164 and 165. On these recording heads 164 and 165 are mounted ink cartridges (not shown) that contain ink. The recording heads 164 and 165 are arranged in the paper width direction. The recording head 164 is disposed offset relative to the recording head 165 to the downstream side in the transport direction. Thus, the length of the recording region of the recording heads 164 and 165 in the transport direction is twice the length of each of the recording heads 164 and 165. For example, while the length of each of the recording heads 164 and 165 in the transport direction is one inch, the length of the recording region of the recording heads 164 and 165 in the transport direction is two inches.

In the recording region of the recording heads 164 and 165, a platen 140 is disposed so as to face the recording heads 164 and 165 in the vertical direction. The platen 140 extends substantially horizontally in the transport direction and the paper width direction, and supports the paper P being transported, from below.

On one side (the right side in the figure) of the platen 140 is disposed a maintenance unit 166 including a cap member. The position where the maintenance unit 166 is disposed is designated as a home position of the carriage 160. When the carriage 160 is at the position, the recording head 164 is covered by the cap member. Thus, the clogging of the recording head 164 caused by drying of ink is prevented.

Figure 3:
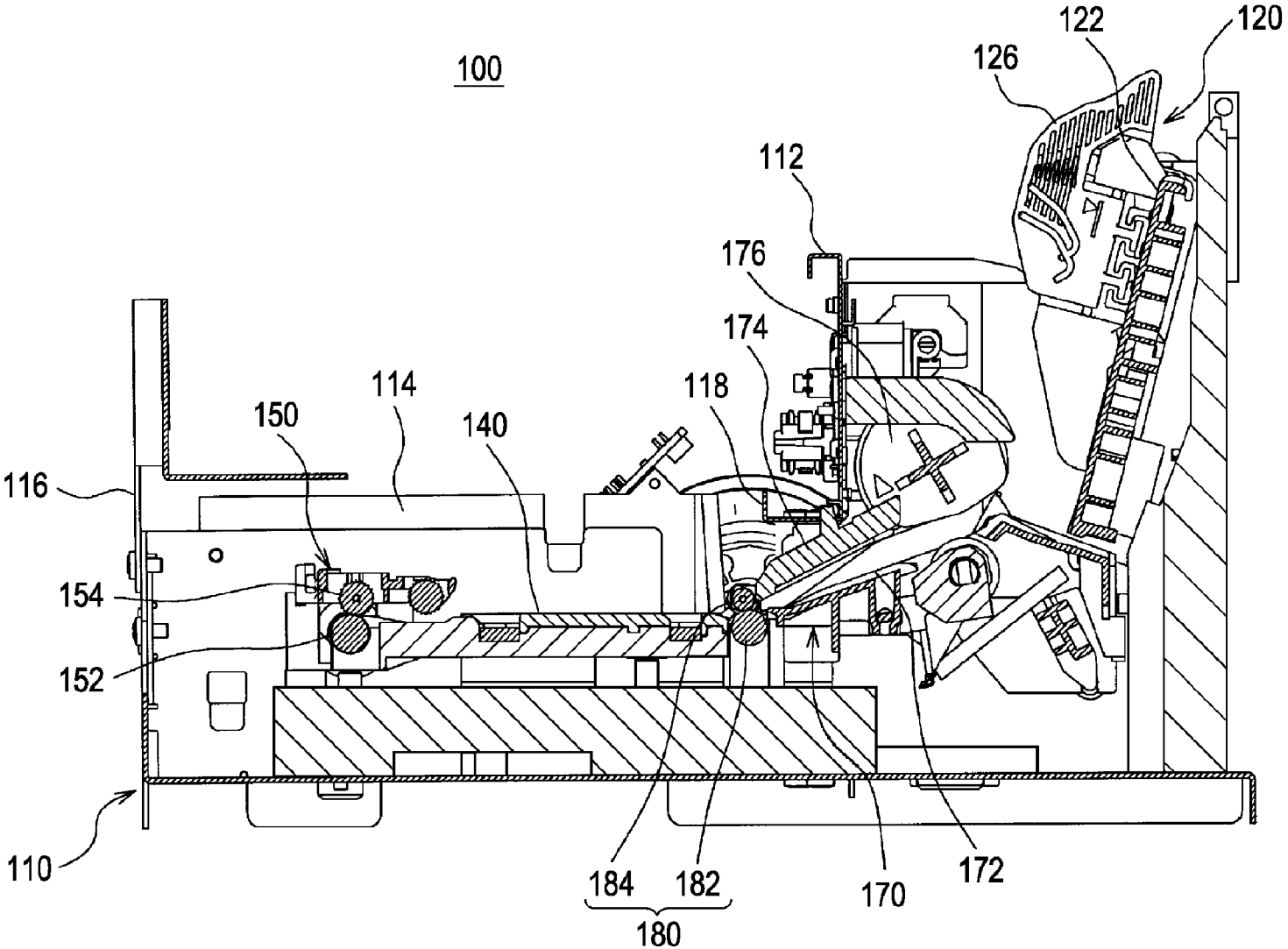
FIG. 3 is a sectional view taken along line III-III of FIG. 2.

Near the lower edge of the paper support 122 is provided a transport section 170 that transports sheets of paper P loaded on the paper support 122 one at a time into the apparatus. FIG. 3 is a sectional view taken along line III-III of FIG. 2. As shown in this figure, the transport section 170 has a transport lower guide 172, a transport upper guide 174, a paper feed roller 176, and a transport roller 180. The transport roller 180 has a transport driving roller 182 and a transport driven roller 184.

The transport lower guide 172, inclining obliquely downward, extends from near the lower edge of the paper support 122 to the front of the apparatus. The transport upper guide 174 is disposed opposite the upper surface of the transport lower guide 172. The paper feed roller 176 is disposed near the lower edge of the paper support 122 and opposite the edge of the transport lower guide 172 on the upstream side in the transport direction. This paper feed roller 176 feeds sheets of paper P loaded on the paper support 122 one at a time toward the front of the apparatus. The transport roller 180 is disposed at the edge of the transport lower guide 172 and transport upper guide 174 on the downstream side in the transport direction. This transport roller 180 nips the paper P fed from the paper feed roller 176 and transports it toward the front of the apparatus.

On the downstream side of the platen 140 in the transport direction is disposed a discharge section 150. The discharge section 150 has a discharge driving roller 152 that is rotationally driven and a discharge driven roller 154 that is rotationally driven by the discharge driving roller 152. The discharge driving roller 152 has a plurality of roller portions arranged in the axial direction at regular intervals.

The discharge driven roller 154 has a plurality of roller portions arranged in the axial direction at regular intervals. The roller portions of the discharge driven roller 154, being in contact with the roller portions of the discharge driving roller 152, are rotationally driven with paper P therebetween. The peripheral portion of each roller portion in the discharge driven roller 154 is toothed, thereby reducing area of contact with the recording surface of paper P.

Figure 4:
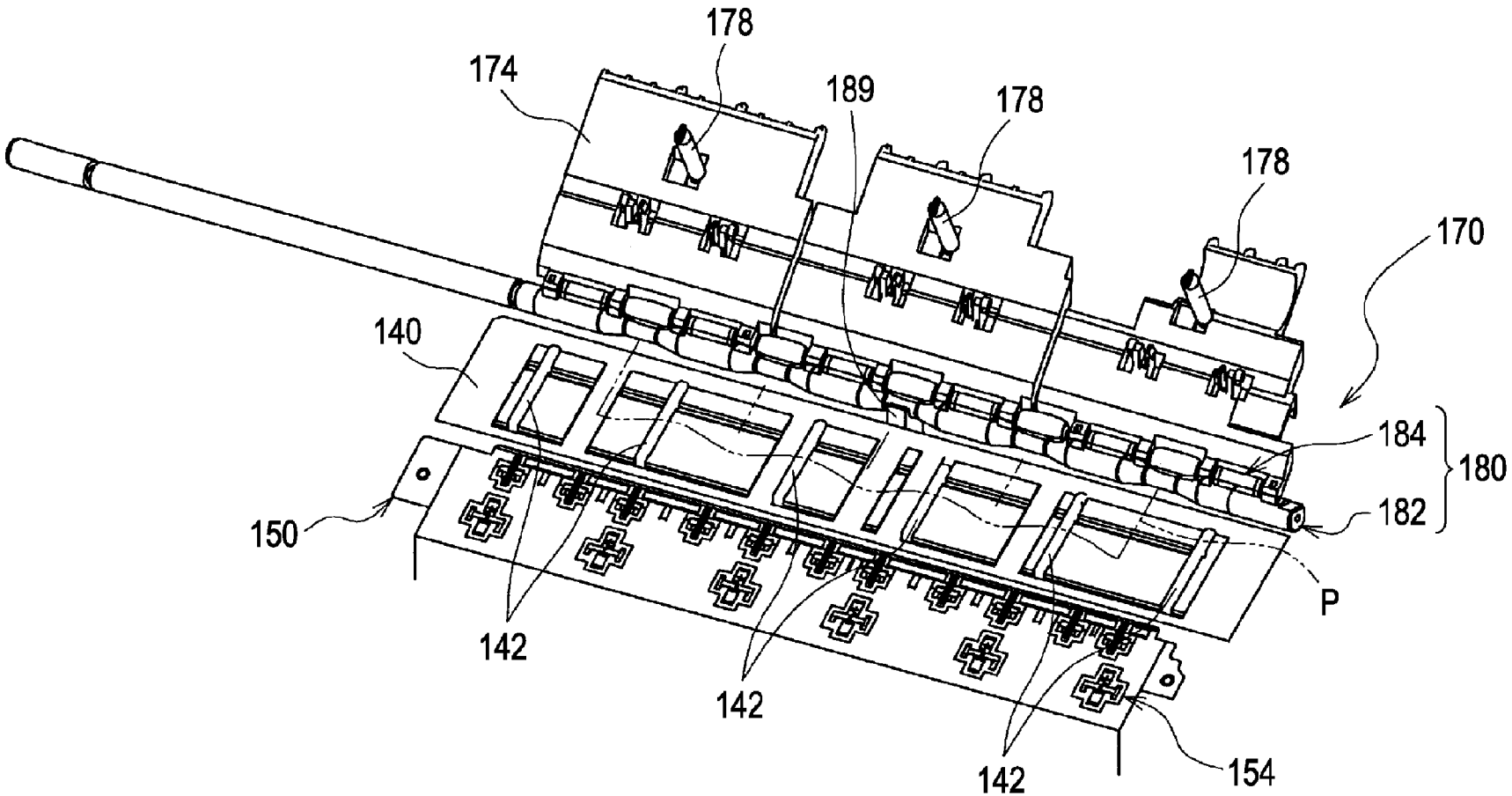
FIG. 4 is a perspective view showing a transport section 170, a platen 140, and a discharge section 150.

FIG. 4 is a perspective view showing the transport section 170, the platen 140, and the discharge section 150. As shown in FIGS. 3 and 4, the transport driving roller 182 is disposed along the paper width direction at the edge of the transport lower guide 172 on the downstream side in the transport direction. This transport driving roller 182 is rotationally driven by a motor 181 (see FIG. 6). The transport driving roller 182 is rotatably supported from below by a bearing portion 189. The transport driven roller 184 is rotatably supported by the edge of the transport upper guide 174 on the downstream side in the transport direction.

The transport lower guide 172 is fixed to the frame 110. On the other hand, the transport upper guide 174 is supported by the rear frame 112 rotatably around an axis extending along the paper width direction. On the upper surface of the transport upper guide 174, a plurality of tension coil springs 178 serving as urging members are disposed along the paper width direction. One end of each tension coil spring 178 in the axial direction is attached to the upper surface of the transport upper guide 174, and the other end in the axial direction is attached to the rear frame 112. The tension coil springs 178 urges the transport upper guide 174 in such a direction that the upstream side in the transport direction is raised and the downstream side in the transport direction is lowered. Thus, the tension coil springs 178 presses the transport driven roller 184, which is disposed at the edge of the transport upper guide 174 on the downstream side in the transport direction, against the transport driving roller 182.

On the upper surface of the platen 140, a plurality of guide ribs 142 extending along the transport direction and serving as downstream side guide ribs are formed at regular intervals in the paper width direction. Each guide rib 142 protrudes upward and is aligned with a corresponding one of the roller portions of the discharge driving roller 152 and a corresponding one of the roller portions of the discharge driven roller 154 in the transport direction.

Figure 5:
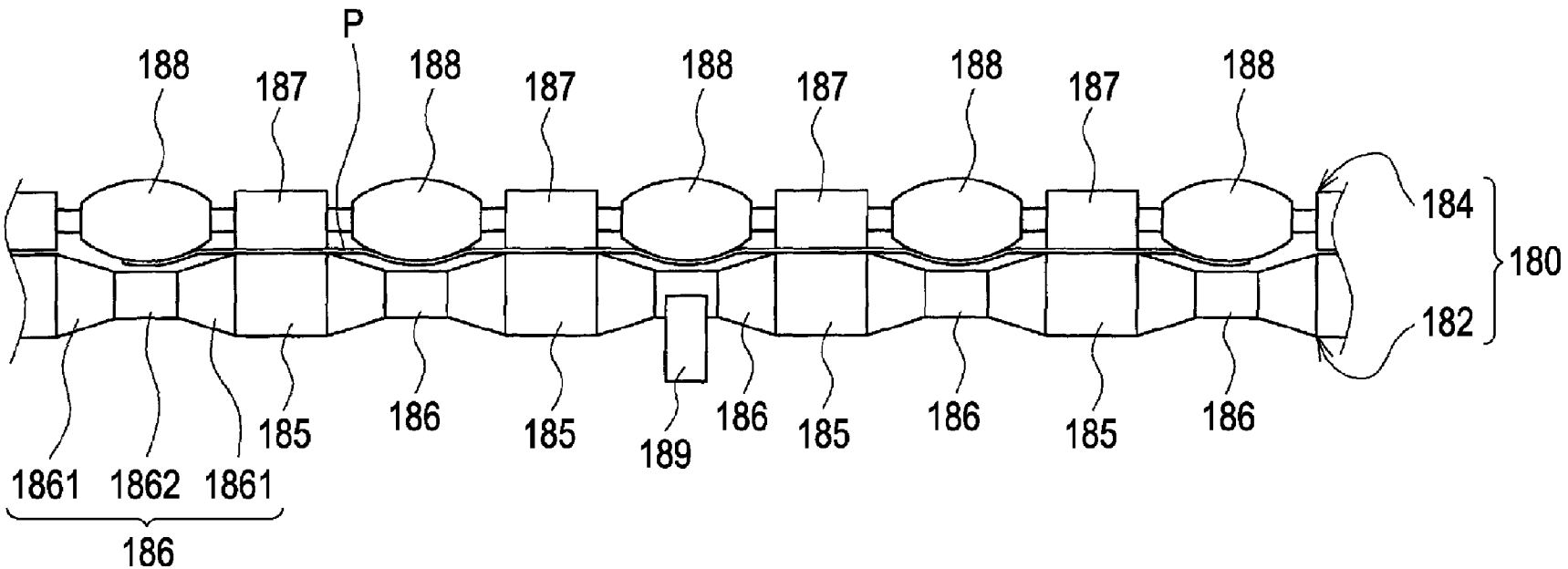
FIG. 5 is a front view showing a transport roller 180.

FIG. 5 is a front view showing the transport roller 180. As shown in this figure, the transport driving roller 182 and the transport driven roller 184 pressed against each other nip and transport paper P. The transport driving roller 182 has a plurality of driving side roller portions 185 that are disposed along the axial direction spaced apart, and a plurality of depressed portions 186 that are each disposed between the driving side roller portions 185. That is, in the transport driving roller 182, the driving side roller portions 185 and the depressed portions 186 are disposed alternately along the axial direction.

The transport driven roller 184 has a plurality of driven side roller portions 187 that are disposed along the axial direction spaced apart, and a plurality of presser rollers 188 that are each disposed between the driven side roller portions 187. That is, in the transport driven roller 184, the driven side roller portions 187 and the presser rollers 188 are disposed alternately along the axial direction.

Each driving side roller portion 185 and a corresponding one of the driven side roller portions 187 are disposed opposite each other in the vertical direction and are pressed against each other. Each depressed portion 186 and a corresponding one of the presser rollers 188 are disposed opposite each other in the vertical direction and are spaced from each other.

The diameter of the depressed portions 186 is smaller than that of the driven side roller portions 187. At each end of each depressed portion 186 in the axial direction is formed a tapered portion 1861 that gradually tapers toward the middle of each depressed portion 186 in the axial direction. In the middle of each depressed portion 186 in the axial direction is formed a thin portion 1862 that has a constant diameter. On the other hand, the presser rollers 188 are formed in a barrel shape. The middle of each presser roller 188 in the axial direction is formed in a substantially cylindrical shape. Both ends of each presser roller 188 in the axial direction are formed in a bowl shape.

The middle of each presser roller 188 in the axial direction faces the thin portion 1862 of a corresponding one of the depressed portions 186, separated therefrom by a gap. Both ends of each presser roller 188 in the axial direction face both tapered portions 1861 of a corresponding one of the depressed portions 186, separated therefrom by a gap. The middle of each presser roller 188 in the axial direction has a diameter larger than that of the driven side roller portions 187, thereby bulging toward the depressed portions 186 compared to the nip portion (contact surface) between the driving side roller portions 185 and the driven side roller portions 187. For this reason, in the paper P transported by the transport roller 180, a plurality of parts arranged at regular intervals in the paper width direction are pressed down by the plurality of presser rollers 188. Thus, the paper P is corrugated so that ridges and grooves alternate in the paper width direction.

Under a central one of the plurality of depressed portions 186 is disposed a bearing portion 189. In the upper part of the bearing portion 189 is formed a U-shaped bearing groove that opens upward. The thin portion 1862 of the depressed portion 186 is rotatably fitted into the bearing groove. That is, the depressed portion 186 is rotatably supported by the bearing portion 189.

The driving side roller portions 185 of the transport driving roller 182 are roughened, for example, by grain finish. On the other hand, the plurality of depressed portions 186 including the depressed portion 186 supported by the bearing portion 189 are not roughened, for example, by grain finish. For this reason, the depressed portion 186 supported by the bearing portion 189 is smooth compared to the driving side roller portions 185. As a result, the sliding resistance between the thin portion 1862 of the depressed portion 186 and the bearing portion 189 is reduced.

The driven side roller portions 187 of the transport driven roller 184 are roughened, for example, by grain finish. On the other hand, the presser rollers 188 are not roughened, for example, by grain finish. For this reason, the surfaces of the presser rollers 188 are smoother than the surfaces of the driven side roller portions 187, and the friction coefficient of the presser rollers 188 is lower than the friction coefficient of the driven side roller portions 187. Thus, the transport impact of the presser rollers 188 on paper P is reduced.

A pair of the presser rollers 188 are disposed at both edges of paper P in the width direction. Both edges of paper P in the width direction are pressed toward the platen 140 by the presser rollers 188. In this embodiment, outermost ones of the plurality of presser rollers 188 are disposed at both edges of paper P in the width direction. However, this is not essential. Other ones of the plurality of presser rollers 188 may be disposed at both edges of paper P in the width direction.

Figure 6:
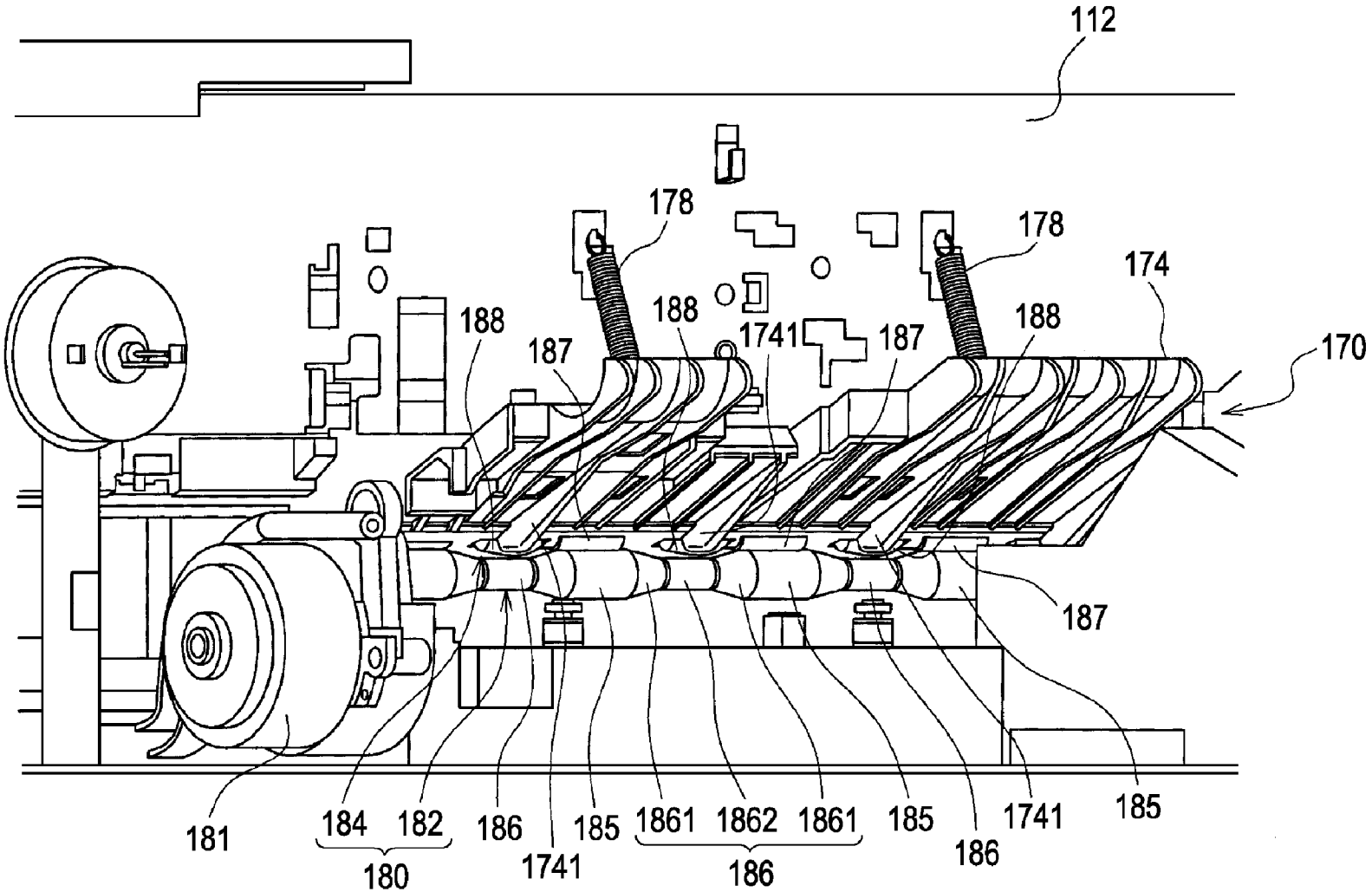
FIG. 6 is a perspective view of a transport section 170 from the upstream side in the transport direction.
Figure 7:
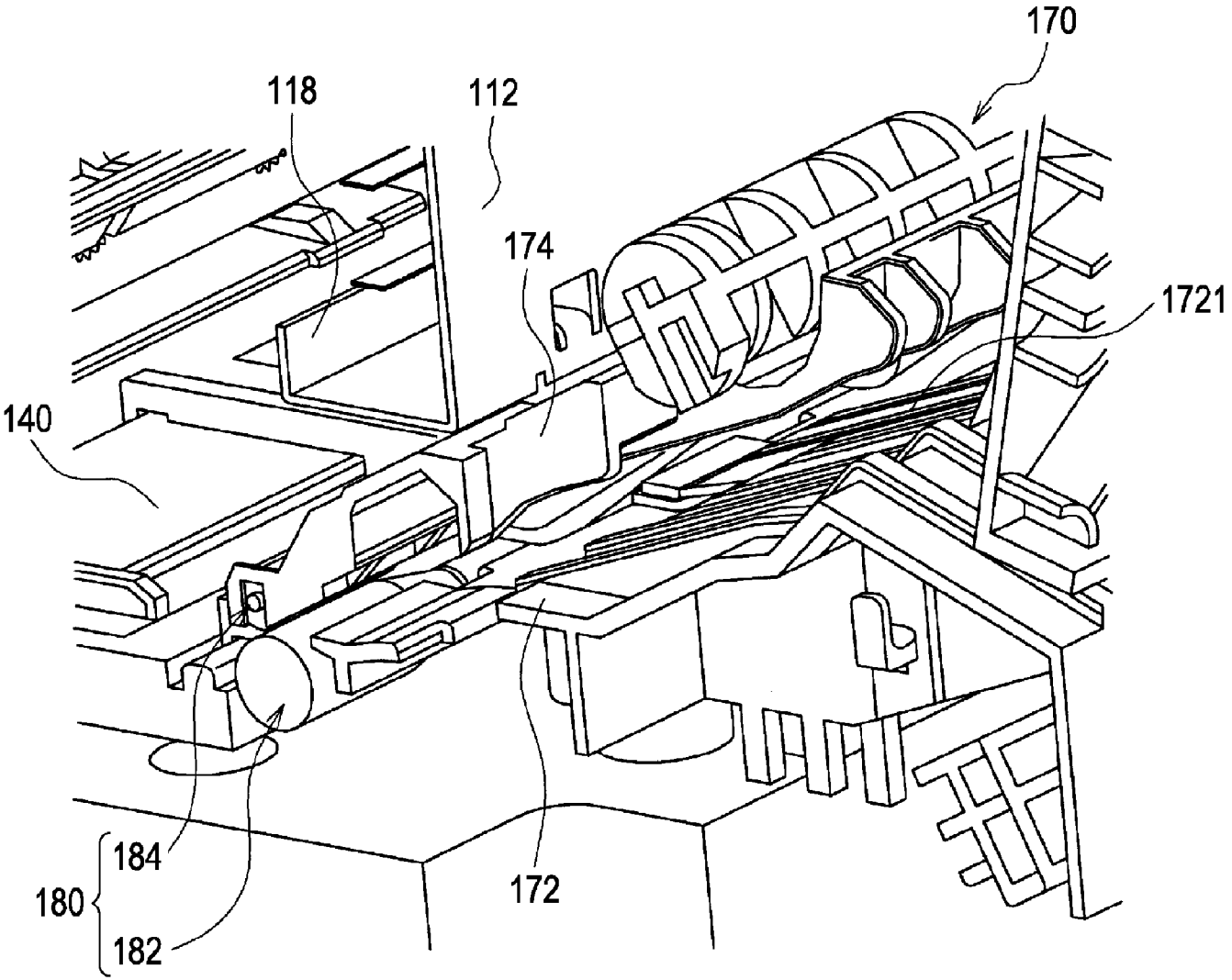
FIG. 7 is a perspective view of a transport section 170 from the upstream side in the transport direction.
Figure 8:
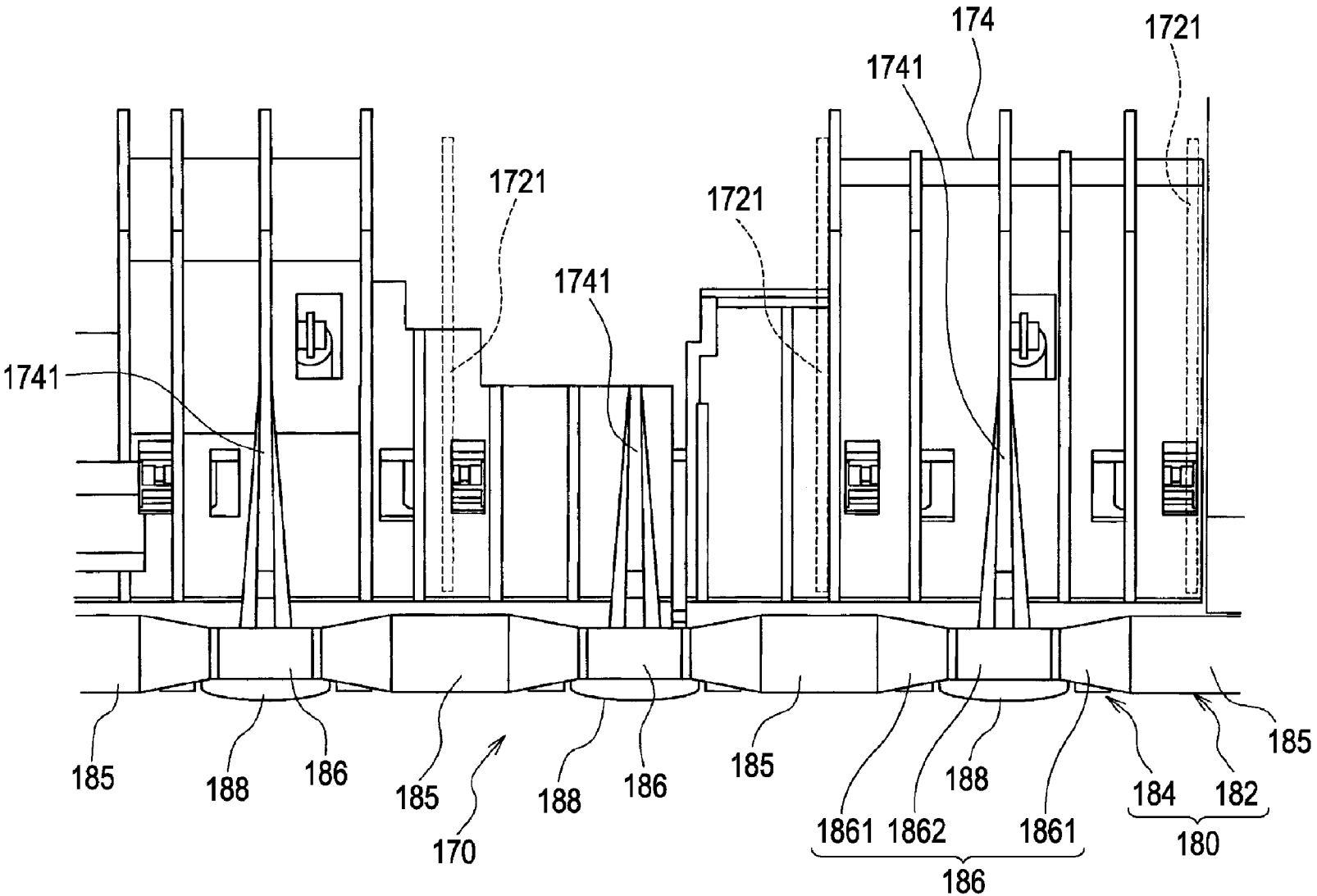
FIG. 8 is a bottom view of a transport section 170.

FIGS. 6 and 7 are perspective views of the transport section 170 from the upstream side in the transport direction. FIG. 8 is a bottom view of the transport section 170. In FIG. 6, the transport lower guide 172 is not shown.

As shown in these figures, on the lower surface of the transport upper guide 174, a plurality of presser ribs 1741 extending along the transport direction are arranged at regular intervals in the paper width direction. Each presser rib 1741 protrudes downward and is aligned in the transport direction with a corresponding one of the presser rollers 188 of the transport driven roller 184. In addition, each presser rib 1741 extends toward the middle in the axial direction of a corresponding one of the presser rollers 188.

The width of each presser rib 1741 in the paper width direction gradually increases toward the downstream end in the transport direction. That is, the distance between side walls of each presser rib 1741 in the paper width direction gradually increases toward the downstream end in the transport direction. The term "the width of each presser rib 1741" here means the distance between the side walls. So, a bifurcate rib is deemed as "a rib with a width in the paper width direction that gradually increases toward the downstream end in the transport direction" if the distance between the side walls gradually increases toward the downstream end in the transport direction.

On the upper surface of the transport lower guide 172, guide ribs 1721 (shown in dashed line in FIG. 8) extending along the transport direction and serving as upstream side guide ribs are formed at regular intervals in the paper width direction. Each guide rib 1721 protrudes upward and is aligned in the transport direction with a corresponding one of the driving side roller portions 185 of the transport driving roller 182. In addition, each guide rib 1721 extends toward the middle in the axial direction of a corresponding one of the driving side roller portions 185.

Next, the working in this embodiment will be described. At the start of a print job in the recording apparatus 100, paper P loaded on the paper feed tray 120 is inserted into between the transport lower guide 172 and the transport upper guide 174 by the paper feed roller 176. The paper P is supported from below by the guide ribs 1721 of the transport lower guide 172 and pressed down by the presser ribs 1741. Thus, the paper P is corrugated so that ridges and grooves alternate in the width direction. Since the width of each presser rib 1741 gradually increases toward the downstream end in the transport direction, the paper P is gradually corrugated.

The corrugated paper P enters between the transport driving roller 182 and the transport driven roller 184. Each ridge of the paper P enters the nip portion between a corresponding one of the driving side roller portions 185 and a corresponding one of the driven side roller portions 187. On the other hand, each groove of the paper P enters the nip portion between a corresponding one of the depressed portions 186 and a corresponding one of the presser rollers 188.

While the paper P passes between the transport driving roller 182 and the transport driven roller 184, each ridge of the paper P is nipped between a corresponding one of the driving side roller portions 185 and a corresponding one of the driven side roller portions 187, and each groove is pressed by a corresponding one of the presser rollers 188 toward a corresponding one of the depressed portions 186. Thus, the paper P is corrugated so that ridges and grooves alternate in the width direction. Since each edge of the paper P in the width direction passes between a corresponding one of the presser rollers 188 and a corresponding one of the depressed portions 186, it is pressed by the presser roller 188 toward the depressed portion 186.

The corrugated paper P, to which transporting force is applied by the transport roller 180, passes between the platen 140 and the recording heads 164 and 165. At this time, the paper P is intermittently transported a length corresponding to the length of the recording region in the transport direction at a time. Every time the paper P is transported a length corresponding to the length of the recording region in the transport direction, the carriage 160 makes a round trip once. While the carriage 160 horizontally moves, the recording heads 164 and 165 discharge ink, thereby forming an image on the paper P. In this embodiment, since the recording heads 164 and 165 are disposed offset relative to each other in the transport direction, the length of the recording region in the transport direction is twice the length of each of the recording heads 164 and 165. Since the distance that the paper P travels at a time can be increased, the transport speed of the paper P can be increased. As a result, the throughput of printing can be improved.

The transport roller 180 applies transporting force to the paper P on which an image is formed, thereby transporting the paper P into the discharge section 150. The paper P passes between the discharge driving roller 152 and the discharge driven roller 154. At this time, the roller portions of the discharge driving roller 152 come into contact with the back of the paper P and apply transporting force. On the other hand, the roller portions of the discharge driven roller 154, bringing their peripheral teeth into contact with the recording surface of the paper P, are rotationally driven. Thus, the paper P is discharged out of the apparatus without the image on the recording surface being disturbed.

In this embodiment, by transporting paper P while corrugating it with the transport roller 180 in the recording region, the second moment of area of paper P being transported in the recording region is increased, and the rigidity of paper P is improved. Thus, the behavior of paper P being transported in the recording region can be stabilized, and so the paper P can be prevented from touching and rubbing the recording heads 164 and 165. In addition, the clearance between the paper P and the recording heads 164 and 165 can be prevented from fluctuating, and so the accuracy of ink hitting the paper P can be improved. As a result, the image quality can be improved.

Since paper P is corrugated not by a corrugating member disposed on the downstream side of the transport roller 180 in the transport direction but by the transport roller 180, the attitude of paper P passing through the transport roller 180 does not change rapidly. So, in the recording region of the recording heads 164 and 165, paper P can be transported further with the attitude stabilized. Thus, even when the recording region of the recording heads 164 and 165 is extended in the transport direction as in this embodiment, the behavior of paper P can be kept stable while the paper P is transported in the recording region. As a result, the paper P can be prevented from touching and rubbing the recording heads 164 and 165, and the accuracy of ink hitting the paper P can be improved.

According to this embodiment, nipped between the driving side roller portions 185 and the driven side roller portions 187, paper P is corrugated. Thus, the violent behavior of paper P being corrugated can be suppressed compared to the case of passing paper P through a space in which ribs are disposed in a zigzag.

By preliminarily corrugating the paper P entering the transport roller 180 with the presser ribs 1741 and the guide ribs 1721, the attitude of paper P transported to the recording region of the recording heads 164 and 165 can be changed more gently. Thus, the behavior of paper P transported in the recording region can be made more stable. In addition, the paper P entering the transport roller 180 can be prevented from being folded and wrinkled.

The width of each presser rib 1741 gradually increases toward the downstream end in the transport direction, and the presser ribs 1741 corrugate paper P gradually. Thus, the attitude of paper P transported to the recording region of the recording heads 164 and 165 can be changed more gently. As a result, the behavior of paper P transported in the recording region can be made more stable.

According to this embodiment, on the platen 140, each guide rib 142 extends along the transport direction on the downstream side in the transport direction of a corresponding one of the driving side roller portions 185 of the transport driving roller 182. The ridges of paper P are supported by the guide ribs 142. Thus, the height of ridges of paper P from the platen 140 becomes equal to the height of the guide ribs 142 and is evened out. As a result, the variation in the clearance between the paper P and the recording heads 164 and 165 can be reduced.

According to this embodiment, each guide rib 1721, a corresponding one of the driving side roller portions 185, a corresponding one of the driven side roller portions 187, a corresponding one of the guide ribs 142, a corresponding one of the roller portions of the discharge driving roller 152, and a corresponding one of the roller portions of the discharge driven roller 154 are arranged in a line along the transport direction. Thus, paper P can be maintained in a good attitude.

The paper P passing through the transport roller 180 tries to flatten and the ridges try to move downward. When each edge of paper P in the width direction corresponds to a ridge, the force that tries to flatten at each edge of paper P in the width direction is strong, and so the attitude of paper P is easily destabilized. In contrast to this, in this embodiment, since the presser rollers 188 make a groove at each edge of paper P in the width direction, the force that tries to flatten at each edge of paper P in the width direction can be suppressed. As a result, the attitude of paper P can be maintained.

According to this embodiment, the driving side roller portions 185 of the transport driving roller 182 and the driven side roller portions 187 of the transport driven roller 184 are roughened. Thus, frictional force can be generated between the paper P and the driving side roller portions 185 and between the paper P and the driven side roller portions 187. As a result, transporting force applied to the paper P by the driving side roller portions 185 and the driven side roller portions 187 can be secured.

On the other hand, the depressed portions 186 of the transport driving roller 182 are not roughened and are smoother than the driving side roller portions 185. Thus, the frictional resistance between the bearing groove in the bearing portion 189 and the thin portion 1862 in the corresponding one of the depressed portions 186 can be reduced. As a result, the abrasion of the bearing groove and the thin portion 1862 can be reduced. In addition, the presser rollers 188 of the transport driven roller 184 are not roughened, and have a friction coefficient lower than that of the driven side roller portions 187. Thus, the frictional resistance between the presser rollers 188 and the paper P can be reduced. As a result, the transport impact of the presser rollers 188 on the paper P can be reduced.

In this embodiment, the presser rollers 188 are formed in a barrel shape, and both ends of each presser roller 188 in the axial direction are curved as viewed from the radial direction. Thus, paper P can be curved along the presser rollers 188. As a result, paper P can be prevented from being folded and rubbed. In addition, the frictional resistance between the presser rollers 188 and the paper P can be further reduced. As a result, the transport impact of the presser rollers 188 on the paper P can be further reduced.

In the above embodiment, in the transport driving roller 182, a driving side roller portion 185 alternates with a depressed portion 186 along the axial direction. On the other hand, in the transport driven roller 184, a driven side roller portion 187 alternates with a presser roller 188 along the axial direction. However, the arrangement of the driving side roller portions 185 and the depressed portions 186, and the arrangement of the driven side roller portions 187 and the presser rollers 188 are not limited to this. Alternatively, a plurality of contiguous driving side roller portions 185 may alternate with a depressed portion 186, or a plurality of contiguous depressed portions 186 may alternate with a driving side roller portion 185. In each case, it is preferable that the same number of driven side roller portions 187 as the driving side roller portions 185 be disposed opposite the driving side roller portions 185, and the same number of presser rollers 188 as the depressed portions 186 be disposed opposite the depressed portions 186. However, the number of driven side roller portions 187 may be different from the number of driving side roller portions 185, and the number of presser rollers 188 may be different from the number of depressed portions 186.

Although the invention has been described with reference to embodiments, the technical scope of the invention is not limited to the above embodiments. It is apparent to those skilled in the art that various changes or modifications may be made in the above embodiments. It is apparent from the claims that such modified or improved embodiments may also be included in the technical scope of the invention.

What is claimed is:

1. A recording apparatus comprising:

a recording head that discharges ink onto a transported recording medium, thereby performing recording;

a transport driving roller that is provided on the upstream side of the recording head in the transport direction and includes driving side roller portions and depressed portions, the driving side roller portions being rotationally driven and thereby transporting the recording medium, the diameter of the depressed portions being smaller than that of the driving side roller portions, the driving side roller portions and the depressed portions being arranged in a direction perpendicular to the transport direction of the recording medium in such a manner that at least one driving side roller portion alternates with at least one depressed portion;

a transport driven roller that is provided opposite the transport driving roller and includes driven side roller portions and presser rollers, the driven side roller portions being driven by the driving side roller portions with the recording medium therebetween, the diameter of the presser rollers being larger than that of the driven side roller portions, the presser rollers pressing the recording medium toward the depressed portions, the driven side roller portions and the presser rollers being arranged in a direction perpendicular to the transport direction of the recording medium in such a manner that at least one driven side roller portion alternates with at least one presser roller;

a presser rib that is provided on the upstream side of each presser roller in the transport direction so as to extend along the transport direction toward the presser roller, the presser rib protruding from the presser roller side toward the depressed portion side, the width of the presser rib in a direction perpendicular to the transport direction increasing toward the downstream end in the transport direction; and an upstream side guide rib that is provided on the upstream side of each driving side roller portion in the transport direction so as to extend along the transport direction toward the driving side roller portion, the upstream side guide rib protruding from the driving side roller portion side toward the driven side roller portion side and supporting the recording medium.

2. The recording apparatus according to claim 1, further comprising at least one bearing portion that rotatably supports at least one of the depressed portions, and wherein the driving side roller portions are roughened, and the at least one of the depressed portion supported by the at least one bearing portion is smoother than the driving side roller portions.

3. The recording apparatus according to claim 1, wherein the friction coefficient of the presser rollers is lower than the friction coefficient of the driven side roller portions.

4. The recording apparatus according to claim 1, wherein a pair of the presser rollers are disposed at both edges of the recording medium in a direction perpendicular to the transport direction.

5. The recording apparatus according to claim 1, further comprising a downstream side guide rib that is provided on the downstream side of each driving side roller portion in the transport direction so as to extend along the transport direction, the downstream side guide rib protruding from the driving side roller portion side toward the driven side roller portion side and supporting the recording medium.

6. The recording apparatus according to claim 1, wherein both ends of each presser roller in the axial direction are curved as viewed from the radial direction.

* * * * *